US009277304B2

(12) United States Patent
Kuze et al.

(10) Patent No.: US 9,277,304 B2
(45) Date of Patent: Mar. 1, 2016

(54) MAGNETIC CIRCUIT FOR LOUDSPEAKER, AND LOUDSPEAKER USING SAME

(71) Applicant: Panasonic Corporation, Osaka (JP)

(72) Inventors: Mitsukazu Kuze, Mie (JP); Satoshi Koura, Mie (JP); Shinya Mizone, Hyogo (JP); Goro Tsuchiya, Mie (JP); Tetsushi Itano, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/453,614

(22) Filed: Aug. 7, 2014

(65) Prior Publication Data

US 2014/0348374 A1 Nov. 27, 2014

Related U.S. Application Data

(63) Continuation of application No. PCT/JP2013/001194, filed on Feb. 28, 2013.

(30) Foreign Application Priority Data

Mar. 19, 2012 (JP) ..... 2012-061450
Mar. 19, 2012 (JP) ..... 2012-061451

(51) Int. Cl.

| | |
|---|---|
| ***H04R 9/00*** | (2006.01) |
| ***H04R 1/00*** | (2006.01) |
| ***H04R 9/02*** | (2006.01) |
| ***H04R 15/00*** | (2006.01) |

(52) U.S. Cl.

CPC ..... *H04R 1/00* (2013.01); *H04R 9/025* (2013.01); *H04R 15/00* (2013.01); *H04R 2209/024* (2013.01)

(58) Field of Classification Search

CPC ..... H04R 9/025; H04R 9/027; H04R 9/026; H04R 15/00; H04R 1/00

See application file for complete search history.

(56) References Cited

U.S. PATENT DOCUMENTS

2004/0197006 A1* 10/2004 Suzuki ..... H04R 1/06 381/410
2007/0289120 A1* 12/2007 Kishi ..... H04R 31/006 29/594
2009/0060254 A1* 3/2009 Sano ..... H04R 9/025 381/412

FOREIGN PATENT DOCUMENTS

| | | |
|---|---|---|
| JP | 55-155193 U | 11/1980 |
| JP | 59-021199 | 2/1984 |
| JP | 61-081292 U | 5/1986 |
| JP | 01-126793 U | 8/1989 |
| JP | 01-126794 U | 8/1989 |
| JP | 02-068596 U | 5/1990 |
| JP | 04-304606 | 10/1992 |

OTHER PUBLICATIONS

International Search Report of PCT Application No. PCT/JP2013/001194 dated May 21, 2013.

* cited by examiner

*Primary Examiner* — Tuan D Nguyen
(74) *Attorney, Agent, or Firm* — Panasonic Patent Center

(57) ABSTRACT

The loudspeaker magnetic circuit is an external-magnet type, and has a magnet, an upper plate, and a lower plate. The magnet is sandwiched between the upper plate and the lower plate. At least one of the lower plate and the upper plate is formed of magnetic powder or a mixture of a magnetic powder and resin.

23 Claims, 6 Drawing Sheets

MAGNETIC CIRCUIT FOR LOUDSPEAKER, AND LOUDSPEAKER USING SAME

BACKGROUND

1. Technical Field

The present disclosure relates to a loudspeaker magnetic circuit used for various types of acoustic equipment, video equipment, and information communications equipment, including in-car use, and also relates to a loudspeaker using the same.

2. Background Art

Hereinafter, a conventional loudspeaker magnetic circuit is described with reference to the drawings. FIG. 9 is a sectional view of conventional loudspeaker magnetic circuit 4. In magnetic circuit 4, magnet 1 of ferritic material is sandwiched between upper plate 2 and lower plate 3. Magnet 1 is produced by sintering a magnetic material. Lower plate 3 is formed in a manner that a metallic plate is processed by a multistage former method. Center pole 3A is formed in the center of lower plate 3.

Magnetic gap 5 is formed between upper plate 2 and center pole 3A. A voice coil is inserted into magnetic circuit 4 and vibrates in the vertical direction by magnetic force. Therefore, the width of magnetic gap 5 has to be determined with extremely high accuracy.

SUMMARY

The loudspeaker magnetic circuit of the present disclosure is of an external-magnet type, and includes a magnet, an upper plate, and a lower plate. The magnet is sandwiched between the upper plate and the lower plate. At least one of the lower plate and the upper plate is formed of magnetic powder or a mixture of magnetic powder and resin.

With the structure above, since at least one of the lower plate and the upper plate is formed of magnetic powder or a mixture of magnetic powder and resin, the loudspeaker magnetic circuit is decreased in weight.

DETAILED DESCRIPTION OF PREFERRED EMBODIMENTS

In recent years, the market has strongly requested manufacturers to provide a loudspeaker with a compact, low-profile, and lightweight body. The request arises from the background of protection of global environment and resources. For example, employing a neodymium magnet in a loudspeaker magnetic circuit is one of effective way to provide a loudspeaker with a compact, low-profile, and lightweight body. Recently, however, rare-metal material such as neodymium has been rapidly increased in price due to its scarcity. As a result, a loudspeaker employing a magnet of a rare-metal material has been increased in price. To provide a low-cost loudspeaker, it is necessary to reduce usage of rare-metal material and to enhance production efficiency of the loudspeaker.

In a case that a ferritic magnet is employed in the loudspeaker magnetic circuit, it is difficult to provide the loudspeaker with a compact, low-profile, and lightweight body. That is, compared to magnets of rare-metal material, ferritic magnets are inferior in magnetic characteristics. A magnetic circuit employing a ferritic magnet is larger and heavier than that employing a magnet of rare-metal material. Therefore, to provide such a loudspeaker with a compact, low-profile, and lightweight body, it is necessary to decrease the weight of the upper plate, the lower plate, and the magnet itself.

Further, if the ferritic magnet is decreased in size to suppress the size of the magnetic circuit, density of magnetic flux in the magnetic gap is decreased. Therefore, in addition to decrease in weight of the upper plate, the lower plate, and the magnet itself, it is also needed to improve the magnetic efficiency of the loudspeaker magnetic circuit.

To address the problems above, the structure of the exemplary embodiment provides a loudspeaker magnetic circuit with a lightweight body.

Figure 1:
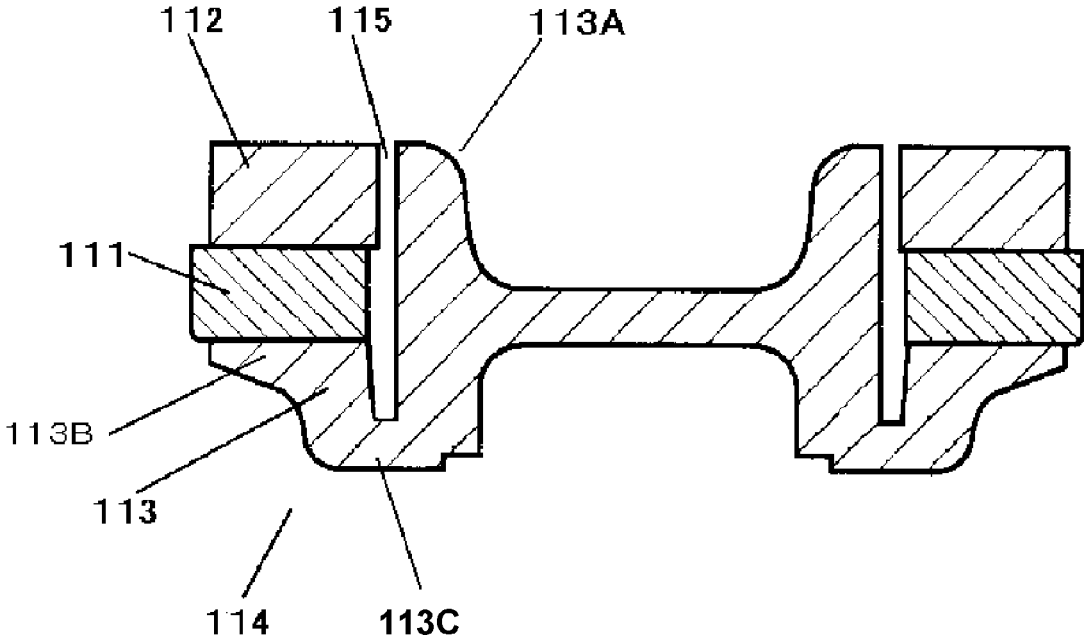
FIG. 1 is a sectional view of a loudspeaker magnetic circuit in accordance with an exemplary embodiment of the present disclosure.

Hereinafter, the loudspeaker magnetic circuit of the embodiment will be described with reference to the drawings. FIG. 1 is a sectional view of the loudspeaker magnetic circuit in accordance with the embodiment. Loudspeaker magnetic circuit 114 is of an external-magnet type. Magnetic circuit 114 has magnet 111, upper plate 112, and lower plate 113. Magnet 111 is sandwiched between upper plate 112 and lower plate 113. At least one of upper plate 112 and lower plate 113 is formed of magnetic powder or a mixture of magnetic powder and resin.

According to the structure above, at least one of lower plate 113 and upper plate 112 has a specific gravity smaller than that of a metal plate, allowing magnetic circuit 114 to be lightweight.

Hereinafter, magnetic circuit 114 will be described in detail. Upper plate 112 is fixed to the upper side of magnet 111. Upper plate 112 has a hole in the center. Center pole 113A is a protrusion and is formed in the central part of lower plate 113. Lower plate 113 has joint section 113B on the outer periphery side of center pole 113A. Further, lower plate 113 has connecting section 113C that connects center pole 113A with joint section 113B.

Magnet 111 is fixed to the upper side of joint section 113B. Center pole 113A protrudes from the central hole of magnet 111 so that the side surface of the upper end of center pole 113A faces the inner side surface in the hole of upper plate 112. Magnetic gap 115 is formed between the inner side surface of upper plate 112 and the side surface of the upper end of center pole 113A.

Upper plate 112 and magnet 111, and lower plate 113 and magnet 111 are fixed, for example, by adhesive, respectively.

Magnet 111 is a sintered magnet and is formed of, for example, a ferrite-based magnetic material. However, the material of magnet 111 is not limited to a ferrite-based material; it may be a metal such as neodymium.

First, the case in which lower plate 113 is formed of magnetic powder or a mixture of magnetic powder and resin will be described. Upper plate 112 can be formed of magnetic material. For example, metal such as iron is employed for the material of upper plate 112.

As described above, employing magnetic powder or a mixture of magnetic powder and resin for lower plate 113 allows lower plate 113 to be decreased in weight.

Not only lower plate 113 but also upper plate 112 may be formed of magnetic powder or a mixture of magnetic powder and resin. The structure above further decreases the weight of magnetic circuit 114. With the structure above, magnetic circuit 114 is further decreased in weight.

Next, the case in which upper plate 112 is formed of magnetic powder or a mixture of magnetic powder and resin will be described. When magnetic powder is employed for the material of upper plate 112, it is easily produced by powder compacting. When a mixture of magnetic powder and resin is employed for the material of upper plate 112, it is easily produced by injection molding. This enhances production efficiency of upper plate 112, allowing magnetic circuit 114 to be produced at lower cost.

In particular, employing a mixture of magnetic powder and resin for upper plate 112 increases dimensional accuracy of upper plate 112. That is, the dimensional accuracy of upper plate 112 is substantially determined by the dimensional accuracy of the mold used for injection molding. Therefore, the dimensional accuracy of upper plate 112 can be easily increased by increasing the dimensional accuracy of the mold for injection molding. As a result, upper plate 112 has dimensional accuracy extremely higher than that of conventional upper plate 2 formed by punching.

That is, magnetic gap 115 can be determined smaller than conventional magnetic gap 5, resulting in increase in density of magnetic flux in magnetic gap 115. Therefore, magnet 111 can be further smaller and/or thinner; accordingly, magnetic circuit 114 also can be smaller and/or thinner.

When upper plate 112 is formed of magnetic powder or a mixture of magnetic powder and resin, lower plate 113 may be produced in a manner that a metal plate is processed by a multi-stage former method. In the case, too, since upper plate 112 is formed of magnetic powder or a mixture of magnetic powder and resin, magnetic circuit 114 can be formed lighter than conventional magnetic circuit 4. Besides, lower plate 113 has high magnetic permeability, increasing density of magnetic flux in magnetic gap 115.

The compounding ratio of magnetic powder and resin—when upper plate 112 and lower plate 113 are formed of a mixture of magnetic powder and resin by injection molding—will be described. The compounding ratio of magnetic powder and resin may not be uniformly determined in upper plate 112 and lower plate 113. In that case, the compounding ratio of the magnetic material on the inner side of upper plate 112 is determined to be larger than the other sections. Further, the compounding ratio of the magnetic material in the outer periphery of center pole 113A is determined to be larger than the other sections.

That is, the compounding ratio of the magnetic material at the inner section of upper plate 112 is larger than that at the outer section of upper plate 112. In addition, the compounding ratio of the magnetic material at the outer section of center pole 113A is larger than that in the center of center pole 113A. The structure above further enhances the efficiency of magnetic circuit 114.

It is preferable that the material of upper plate 112 and lower plate 113 be a metal with high permeability and high saturation flux density, such as the following materials: pure iron, ferro silicon (Fe—Si alloy series), permendur (Co—Fe alloy series), permalloy (Ni—Fe alloy series), sendust (Fe—Al—Si alloy series), MnZn alloy series, soft ferrite series, Fe-based, or Co-based amorphous series, and nano-crystallites magnetic material. Further, the material of upper plate 112 and lower plate 113 may be determined in a manner that a single or several types of materials are selected from phosphorus, chrome, cobalt, vanadium, and molybdenum and then the selected material is added to the aforementioned metal material.

Figure 2:
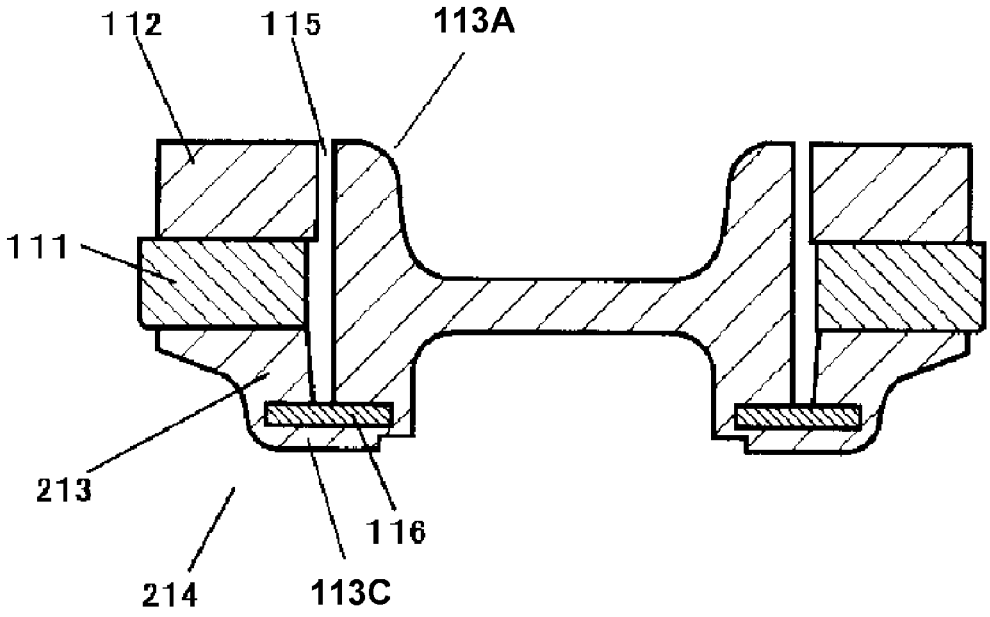
FIG. 2 is a sectional view of another loudspeaker magnetic circuit in accordance with the exemplary embodiment of the present disclosure.

FIG. 2 is a sectional view of magnetic circuit 214 of the embodiment. Magnetic circuit 214 has lower plate 213 instead of lower plate 113 of magnetic circuit 114. More specifically, magnetic member 116 is disposed in connecting section 113C of lower plate 213. Center pole 113A is disposed in the center of lower plate 213. Magnetic gap 115 is formed between the inner side surface of upper plate 112 and the side surface of the upper end of center pole 113A.

Lower plate 213 is formed of magnetic powder or a mixture of magnetic powder and resin. This allows magnetic circuit 214 to be lightweight. Further, with the structure above, the part having magnetic member 116 in lower plate 213 has high permeability. As a result, the density of magnetic flux in magnetic gap 115 can be increased. Therefore, even when lower plate 213 having a permeability lower than conventional lower plate 3 formed of metal is used, magnetic flux density in magnetic gap 115 can be increased.

Magnetic member 116 is not divided. For example, when magnet 111 has a ring shape, magnetic member 116 is also formed into a ring shape.

Magnetic member 116 may be formed of any material as long as magnetic flux passes therethrough. However, it is preferable that magnetic member 116 be formed of material such that the magnetic permeability of magnetic member 116 is larger than that of the magnetic powder or the mixture of the magnetic powder and the resin. For example, magnetic member 116 is an iron plate. The structure improves the permeability of the whole of lower plate 213.

To suppress magnetic saturation of lower plate 213 and increase magnetic flux density in magnetic gap 115, lower plate 213 is formed of a material with further high permeability and high saturation flux density.

For such a purpose, magnetic member 116 is formed of metal materials as the following: pure iron, ferro silicon (Fe—Si alloy series), permendur (Co—Fe alloy series), permalloy (Ni—Fe alloy series), sendust (Fe—Al—Si alloy series), MnZn alloy series, soft ferrite series, Fe-based or Co-based amorphous series, and nano-crystallites magnetic material.

The material used for magnetic member 116 is selected from the above-mentioned materials so that the permeability of magnetic member 116 has an intended value. In this case, the metal material of one or more is selected from the above-mentioned materials. When two or more metal materials are used, the materials may be alloyed.

Next, the position at which magnetic member 116 is disposed will be described. Magnetic member 116 is disposed at the position where magnetic saturation is likely to cause in lower plate 213. Generally, magnetic saturation easily occurs at the root section of center pole 113A. Therefore, locating magnetic member 116 at the root section of center pole 113A improves the permeability of lower plate 213. As a result, magnetic flux density in magnetic gap 115 is increased.

That is, magnetic member 116 is preferably disposed at connecting section 113C. The structure above enhances the permeability of lower plate 213, increasing magnetic flux density in magnetic gap 115.

In this case, the length between the inner periphery and the outer periphery of magnetic member 116 is determined to be larger than the width of magnetic gap 115. With the structure above, the permeability of lower plate 213 is further improved and magnetic flux density in magnetic gap 115 is further increased.

The shape of magnetic member 116 is not particularly limited. For example, when magnetic circuit 214 is circular, magnetic member 116 is shaped by punching out a metal plate into a ring shape. Forming magnetic member 116 into such a shape improves productivity of magnetic member 116.

The outside shape of magnetic circuit 214 as viewed from above, for example, is circular, however, it is not limited to the shape; it may be rectangular, like a racetrack, or oval. Also in those cases, the shape of magnetic member 116 is determined so as to be suitable for the shape of magnetic circuit 214. That is, according to the shape and characteristics of magnetic circuit 214, magnetic member 116 of a shape that improves permeability is disposed at the position where magnetic saturation is likely to cause.

Besides, magnetic member 116 may be divided into two or more and disposed in lower plate 213. In this case, it is preferable that the divided pieces of magnetic member 116 have the same shape. The structure reduces the kinds of mold for processing magnetic member 116, suppressing the cost of equipment for processing magnetic member 116. For example, when magnet 111 has a ring shape viewed from above, the shape of each of magnetic members 116 viewed from above is determined to be an are. In this case, arc-shaped magnetic members 116 are circumferentially arranged on the same circle.

In this case, it is preferable that magnetic members 116 be disposed at the positions which are the most effective in enhancing permeability of lower plate 213. This allows magnetic members 116 to reduce in size, resulting in cost-reduced production of lower plate 213.

Besides, when the shape of each of magnetic members 116 is determined from the viewpoint of efficiency in material handling and productivity, magnetic members 116 can be produced at low cost. For example, when magnetic member 116 is shaped into an are, four-or-more pieces of magnetic members 116 are arranged on a circle. That is, the circumferential angle of each piece of magnetic members 116 is determined to be less than 45 degrees. The structure decreases material loss in processing magnetic members 116.

When the shape of magnetic circuit 214 as viewed from above is rectangular, magnetic member 116 has an outer shape of rectangular. In the center of magnetic member 116, a rectangular hole is formed. Alternatively, magnetic member 116 may be formed of a combination of two rectangular magnetic materials of different length. When the outer shape of magnetic circuit 214 as viewed from above is a racetrack shape (oval), the outer shape of magnetic member 116 is determined to have a racetrack shape. In this case, a racetrack-shaped hole is formed in the center of magnetic member 116. Alternatively, magnetic member 116 may be formed of a combination of two kind of magnetic members of different shape, i.e., a linearly shaped one and a curved one.

Next, the method of manufacturing lower plate 213 will be described. When lower plate 213 is formed of magnetic powder, lower plate 213 is generally formed by a powder compacting method. Lower plate 213 is formed by the method in a manner that magnetic powder is processed to be molded and then heated at high temperature. When lower plate 213 is formed of a mixture of magnetic powder and resin, lower plate 213 is formed by injection molding.

Conventional lower plate 3 is formed by a multistage former method. In the multistage former method, a lump of metal material is repeatedly forged until an intended final shape is obtained. Therefore, it needs a lot of steps and time for processing lower plate 3.

In contrast, lower plate 213 can be formed by powder compacting or injection forming. Lower plate 213 is produced with productivity much higher than conventional lower plate 3. In this way, forming by powder compacting and injection forming allows lower plate 213 to have flexibility in shaping higher than lower plate 3. That is, a thin-walled part can be easily formed in lower plate 213, by which lower plate 213 is formed further lightweight. Additionally such formed structure decreases the amount of the materials, i.e., magnetic powder and resin, producing lower plate 213 at low cost.

When lower plate 213 is formed of a mixture of magnetic powder and resin, the dimensional accuracy of lower plate 213 can be increased easily. The dimensional accuracy of lower plate 213 is substantially determined by the dimensional accuracy of the mold used for injection molding. Therefore, the dimensional accuracy of lower plate 213 can be easily increased by increasing the dimensional accuracy of the mold for injection molding. As a result, the positional accuracy of the side surface of center pole 113A is also improved.

Therefore, the width of magnetic gap 115 can be smaller than that of conventional magnetic gap 5. That is, the magnetic flux density in magnetic gap 115 can be increased. This allows magnet 111 to have reduction in size and/or thickness, resulting in magnetic circuit 213 with reduction in size and/or thickness.

Although magnetic member 116 is embedded in the inside of lower plate 213 by insert molding, it is not limited to: magnetic member 116 may be fixed to the bottom of lower plate 213. In this case, lower plate 213 and magnetic member 116 may be integrated by outsert molding.

As described above, integrating lower plate 213 with magnetic member 116 by insert molding or outsert molding improves bonding strength between lower plate 213 and magnetic member 116. Lower plate 213 can be produced with further enhanced productivity.

Lower plate 213 and magnetic member 116 may be integrated by bonding after the injection molding process.

Figure 3A:
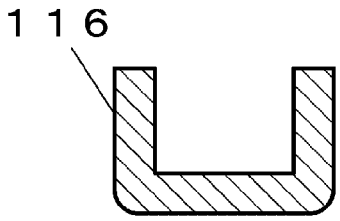
FIG. 3A is a sectional view of a magnetic member used for the loudspeaker magnetic circuit in accordance with the exemplary embodiment of the present disclosure.
Figure 3B:
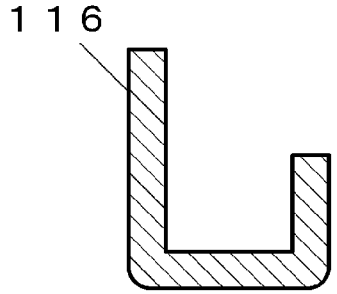
FIG. 3B is a sectional view of another magnetic member used for the loudspeaker magnetic circuit in accordance with the exemplary embodiment of the present disclosure.
Figure 3C:
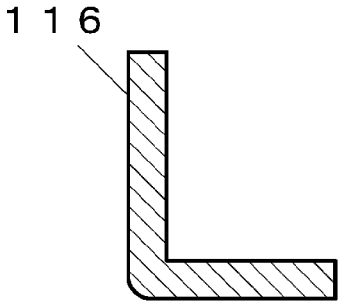
FIG. 3C is a sectional view of still another magnetic member used for the loudspeaker magnetic circuit in accordance with the exemplary embodiment of the present disclosure.

Next, other preferable shapes of magnetic member 116 will be described. FIGS. 3A, 3B, and 3C are sectional views seen from the side of magnetic members 116 of different shapes.

The cross-section seen from the side of magnetic member 116 may be a "U" shown in FIG. 3A, may be a "J" shown in FIG. 3B, or may be an "L" shown in FIG. 3C.

The permeability of magnetic member 116 is greater than that of magnetic powder contained in lower plate 213. The structure above allows lower plate 213 to have further increase in permeability.

Figure 4A:
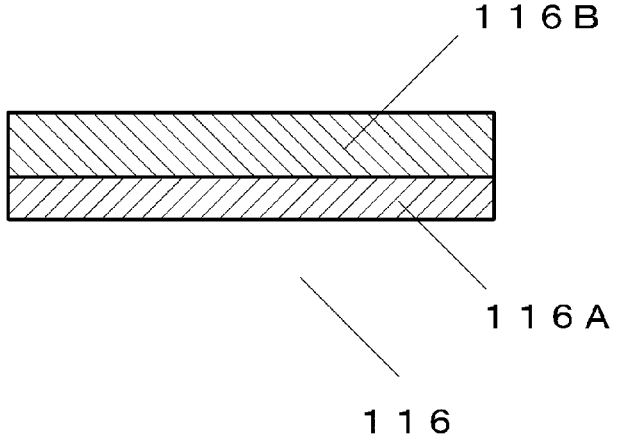
FIG. 4A is a sectional view of still another magnetic member used for the loudspeaker magnetic circuit in accordance with the exemplary embodiment of the present disclosure.
Figure 4B:
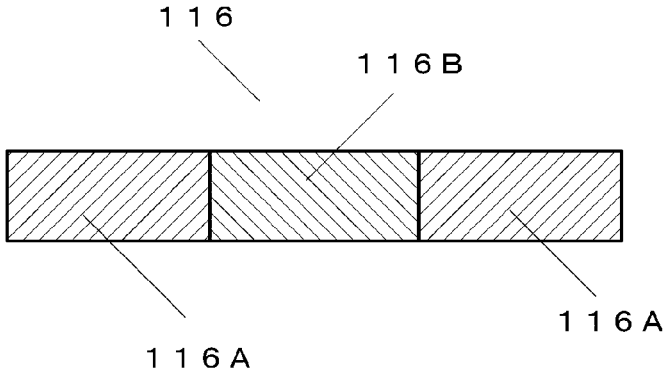
FIG. 4B is a sectional view of still another magnetic member used for the loudspeaker magnetic circuit in accordance with the exemplary embodiment of the present disclosure.

Further preferred structures of magnetic member 116 will be described in more detail with reference to FIG. 4A and FIG. 4B. FIG. 4A and FIG. 4B are sectional views seen from the side of other magnetic members 116. Magnetic member 116 shown in FIG. 4A or FIG. 4B is formed of two-or-more types of magnetic material of metal. That is, magnetic member 116 contains second magnetic section 116A formed of a first magnetic material and first magnetic section 116B formed of a second magnetic material.

For example, in magnetic member 116 shown in FIG. 4A, first magnetic section 116B is disposed on second magnetic section 116A. Magnetic member 116 of the embodiment is disposed in connecting section 113C in a manner that first magnetic section 116B is positioned on the upper side. In this case, the material of second magnetic section 116A and first magnetic section 116B is selected so that the permeability of first magnetic section 116B is greater than that of second magnetic section 116A. According to the structure, first magnetic section 116B is closer to the lower end section of center pole 113A than second magnetic section 116A. Magnetic member 116 may be a layered structure of three-or-more kinds of magnetic material layered in the vertical direction. In this case, magnetic member 116 is structured so that the magnetic material disposed uppermost has the greatest permeability.

In magnetic member 116 shown in FIG. 4B, second magnetic section 116A is disposed on both sides of first magnetic section 116B in the lateral direction. In this case, first magnetic section 116B is disposed below the lower end of center pole 113A. Magnetic member 116 may be a structure of three-or-more kinds of magnetic material laterally arranged. In this case, magnetic member 116 is structured so that the magnetic material disposed close to the lower end of center pole 113A has the greatest permeability. Although second magnetic section 116A is disposed on both sides of first magnetic section 116B in the lateral direction, it is not limited to; for example, second magnetic section 116A may be disposed on either one side of first magnetic section 116B in the lateral direction.

With the structures above, second magnetic section 116A with high permeability can be located at the part where magnetic saturation is most likely to occur. The structures above allow lower plate 213 to have increase in permeability. The permeability of second magnetic section 116A is lower than that of first magnetic section 116B, that is, the material of second magnetic section 116A is more inexpensive than that of first magnetic section 116B. Therefore, the amount of a magnetic material with high permeability can be reduced, which lowers the cost of magnetic member 116.

In magnetic member 116 shown in FIG. 4A or FIG. 4B, second magnetic section 116A is connected with first magnetic section 116B in advance. Second magnetic section 116A and first magnetic section 116B are connected by adhesive bonding or crimping. The in-advance connection reduces a manufacturing step from the molding process, contributing to low-cost production of magnetic member 116. Second magnetic section 116A and first magnetic section 116B may not be connected; for example, first magnetic section 116B may only make contact with second magnetic section 116A. As another possible structure, magnetic powder or a mixture of magnetic powder and resin is disposed between second magnetic section 116A and first magnetic section 116B. In this case, second magnetic section 116A and first magnetic section 116B are disposed apart, having no contact with each other.

Magnet 111 may be a so-called bonded magnet. The bonded magnet is formed of a mixture of magnetic powder and resin. Compared to conventional ferritic magnet 1, magnet 111 formed of a bonded magnet is considerably light. In addition, magnet 111 of a bonded magnet can be easily produced by injection molding, which decreases the production cost. As a result, the structure allows magnetic circuit 114 to be lightweight and to be produced at low cost.

As for magnet 111 of a bonded magnet, the followings can be employed: ferritic; alnico; Sm—Co series; Nd—Fe—B series; Sm—Fe—N series; and Fe—N series. The material of magnetic powder used for the bonded magnet may be selected only one from above or may be a mixture of two-or-more materials selected from above.

A ferritic magnet of general type has extremely low dimensional accuracy. It comes from the manufacturing method—a ferritic magnet is manufactured by a sintering method. In the sintering method, magnetic material is obtained by sintering at high temperature. However, ferritic material has large amount of shrinkage in the sintering process, and variations in shrinkage amount are also large.

Figure 9:
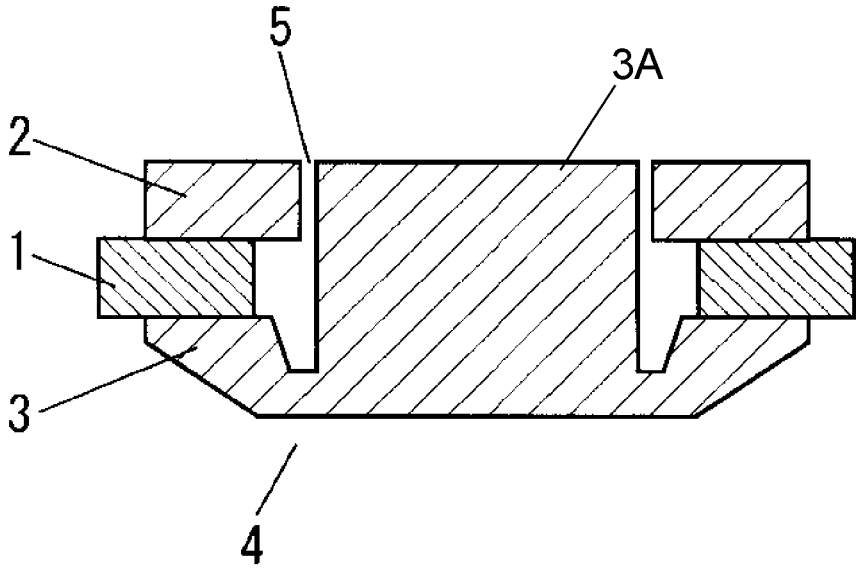
FIG. 9 PRIOR ART
FIG. 9 is a sectional view of a conventional loudspeaker magnetic circuit.

Therefore, after sintering, conventional magnet 1 of ferritic material needs a process of correcting the outer dimensions. Generally, according to conventional magnet 1 shown in FIG. 9, the dimension in the thickness direction is properly determined by cutting. This is because poor accuracy of the distance between the poles of magnet 1 is the major cause of variations in magnitude of magnetic force of magnet 1.

On the other hand, variations in the dimension of magnet 1 in the radial direction have a small effect on variations in magnitude of magnetic force of magnet 1, and therefore, the radial dimension is usually not adjusted. As a result, magnet 1 of ferritic material has very poor dimensional accuracy in the radial direction.

The poor dimensional accuracy in the radial direction of magnet 1 adversely affects the design of magnetic circuit 4. Specifically, an additional unavailing portions are needed in the inward and outward directions of magnet 1. When magnet 1 has a ring shape, there is area portion where magnet 1 cannot be disposed in the inner side of magnet 1. Due to the portion, magnet 1 is designed so that the inner side surface of magnet 1 is outwardly shifted in the radial direction from the inner side surface of upper plate 2. That is, the inner diameter of magnet 1 has to be larger than that of upper plate 2, which inevitably increases the outer diameter of magnet 1. As a result, conventional magnetic circuit 4 has difficulty in having a compact, low-profile, and lightweight structure.

Of course, the dimension of magnet 1 in the radial direction can be adjusted. However, the dimensional adjustment in the radial direction of magnet 1 increases the cost of magnet 1. Besides, decreasing the external dimensions weakens magnetic force of magnet 1, degrading magnetic efficiency of magnetic circuit 4.

In contrast, magnet 111 of a bonded magnet has an amount of shrinkage and variations in the amount of shrinkage smaller than a magnet formed by sintering. Therefore, magnet 111 of a bonded magnet can be produced with very high dimensional accuracy. The dimensional accuracy of magnet 111 is substantially determined by the dimensional accuracy of the mold used for injection molding. Therefore, the dimensional accuracy of magnet 111 can be easily increased by increasing the dimensional accuracy of the mold for injection molding. As a result, magnet 111 of a bonded magnet has dimensional accuracy extremely higher than that of conventional magnet 1 formed by sintering.

Accordingly, the inner side surface of magnet 111 is disposed close to the inner side surface of upper plate 112, reducing the portion where magnet 111 cannot be disposed. This decreases the external dimensions of magnet 111, resulting in reduction in size of magnetic circuit 114.

Further, magnet 111 of a bonded magnet has no need of dimensional adjustment. As a result, the manufacturing steps of magnet 111 can be reduced, and accordingly, magnet 111 is produced at low cost.

Magnet 111 of a bonded magnet may undergo adjustment of external dimensions. The adjustment allows the inner side surface of magnet 111 to locate closer to the inner side surface of upper plate 112. This provides magnetic circuit 114 with further decrease in size.

Meanwhile, cutting on magnet 111 of a bonded magnet is easier than that on sintered magnet 1, and defects such as a crack by cutting hardly occur. Therefore, even when magnet 111 is processed by cutting, compared to cutting on magnet 1, increase in cost of magnet 111 is suppressed.

When both of lower plate 113 (or lower plate 213) and upper plate 112 are formed of magnetic powder or a mixture of magnetic powder and resin and magnet 111 is a bonded magnet, magnetic circuit 114 provides high magnetic efficiency. This allows magnet 111 to be decreased in size and/or thickness. As a result, magnetic circuit 114 is decreased in size and/or thickness. Even when magnet 111 is decreased in size and/or thickness, the structure suppresses decrease in density of magnetic flux in magnetic gap 115.

Figure 5:
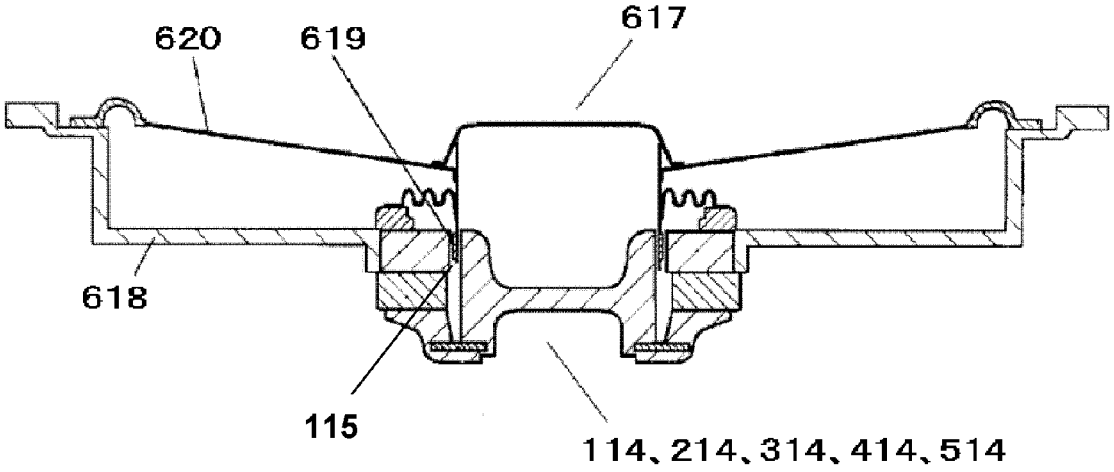
FIG. 5 is a sectional view of a loudspeaker in accordance with the exemplary embodiment of the present disclosure.

FIG. 5 is a sectional view of a loudspeaker using the magnetic circuit of the embodiment of the present disclosure. Loudspeaker 617 has magnetic circuit 114, frame 618, voice coil 619, and diaphragm 620. Frame 618 is connected to magnetic circuit 114. Voice coil 619 is inserted in magnetic gap 115. Voice coil 619 is connected to the center of diaphragm 620. The peripheral section of diaphragm 620 is connected with the outer periphery of frame 618. Instead of magnetic circuit 114, magnetic circuit 214 may be employed. Further, instead of magnetic circuit 114, any one of magnetic circuits 314, 414, and 514 (to be described later) may be employed.

With the structure above, loudspeaker 617 can satisfy market demands for reduction in size, thickness, and weight. In addition to reduction in size, thickness, and weight, the structure provides loudspeaker magnetic circuit 114 and the loudspeaker with high quality. Furthermore, magnetic circuit 114 offers good productivity producing loudspeakers at low cost.

When magnet 111 is formed of a bonded magnet, and when upper plate 112 and lower plate 113 are formed of a mixture of magnetic powder and resin, the resin material used for magnet 111, upper plate 112, and lower plate 113 is not particularly limited. For example, the followings can be employed: as for thermoplastic resin, polypropylene, polyethylene, polyvinyl chloride, polyester, polyamide, polycarbonate, polyvinyl alcohol, and polyphenylene sulfide; as for thermoplastic elastomer, olefin, ester, and polyamide; as for thermosetting resin, epoxy, and phenolic resin.

Magnet 111, upper plate 112, and lower plate 113 are formed of a material of one kind or a mixture of materials of two-or-more kinds selected from the aforementioned materials of resin or elastomer.

Next, the assembling method of magnetic circuit 114 will be described. The upper surface of magnet 111 is attached to the lower surface of upper plate 112 with adhesive. Similarly, the lower surface of magnet 111 is attached to lower plate 113 with adhesive. With the structure above, magnet 111, upper plate 112, and lower plate 113 are firmly connected together. If magnetic circuit 114 is subject to impact, for example, caused by dropping, the firm connection prevents the connected part from being come off. As a result, the structure provides the loudspeaker with excellent quality and reliability.

The connection between magnet 111 and upper plate 112 and the connection between lower plate 113 and magnet 111 is not limited to adhesive bonding. When magnet 111 is formed of a bonded magnet and upper plate 112 is formed of a mixture of thermoplastic resin and magnetic powder, or when magnet 111 is formed of a bonded magnet and lower plate 113 is formed of a mixture of thermoplastic resin and magnetic powder, magnet 111 and upper plate 112, or magnet 111 and lower plate 113 can be connected by welding. That is, magnet 111 may be connected with upper plate 112 by melting the connecting surfaces of magnet 111 and upper plate 112. Similarly, magnet 111 may be connected with lower plate 113 by melting the connecting surfaces of magnet 111 and lower plate 113. In this case, adhesive is not required for connection between magnet 111 and upper plate 112 and/or connection between lower plate 113 and magnet 111. Accordingly, this allows magnetic circuit 114 to form into a low-profile structure by a thickness of adhesive. Further, according to the structure, there is not non-magnetic material between magnet 111 and upper plate 112, and/or between lower plate 113 and magnet 111, which enhances magnetic efficiency of magnetic circuit 114.

For example, magnet 111 and upper plate 112, and/or lower plate 113 and magnet 111 are easily welded by ultrasonic heating. This provides magnetic circuit 114 with good productivity.

Alternatively, magnet 111 and upper plate 112, and/or lower plate 113 and magnet 111 may be connected by a solvent. In this case, the connecting surfaces between magnet 111 and upper plate 112, and/or between lower plate 113 and magnet 111 are melted by the solvent. Therefore, magnet 111 and upper plate 112, and/or lower plate 113 and magnet 111 can be connected with no need for a heat source of ultrasonic or the like, i.e., large-scale equipment such as a ultrasonic generator. Further, the connecting method suppresses consumption of electric energy required for connection between magnet 111 and upper plate 112, and/or between lower plate 113 and magnet 111. Accordingly, the production cost of magnetic circuit 114 is decreased.

Figure 6A:
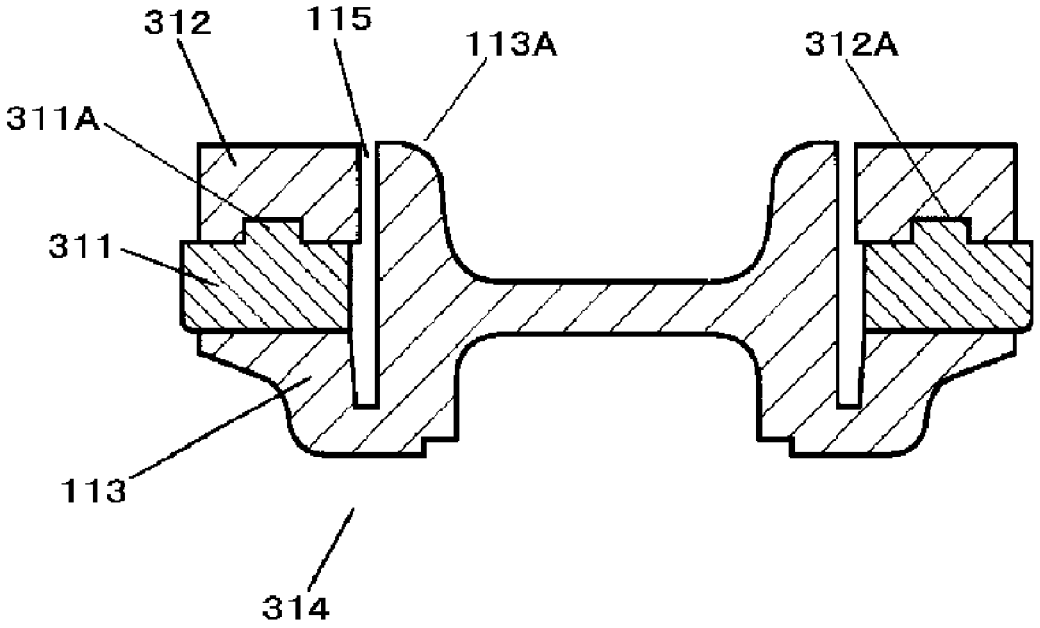
FIG. 6A is a sectional view of another loudspeaker magnetic circuit in accordance with the exemplary embodiment of the present disclosure.

FIG. 6A is a sectional view of still other magnetic circuit 314 of the exemplary embodiment of the present disclosure. Magnetic circuit 314 has magnet 311, upper plate 312, and lower plate 113. Magnet 311 is sandwiched between upper plate 312 and lower plate 113.

Upper plate 312 is fixed on the upper side of magnet 311. Magnet 311 is fixed on the upper side of lower plate 113. Center pole 113A protrudes from the central hole of magnet 311 so that the side surface of the upper end of center pole 113A faces the inner side surface in the hole of upper plate 312. Magnetic gap 115 is formed between the inner side surface of upper plate 312 and the side surface of the upper end of center pole 113A.

Magnet 311 is formed of a bonded magnet. Upper plate 312 and lower plate 113 are formed of magnetic powder or a mixture of magnetic powder and resin.

As for the magnetic powder and resin material of magnet 311, upper plate 312, and lower plate 113, the materials described earlier are employed. Magnet 311 and upper plate 312, and magnet 311 and lower plate 113 may be connected by any of the aforementioned connecting methods. Further, instead of lower plate 113, lower plate 213 may be used.

At least upper plate 312 is formed of magnetic powder or a mixture of magnetic powder and resin. Magnet 311 has first control section 311A for determining the position of upper plate 312. First control section 311A is formed on the upper surface of magnet 311. Further, upper plate 312 has first controlled section 312A that is subject to the positional control of first control section 311A. First controlled section 312A is formed on the lower surface of upper plate 312. Upper plate 312 is properly positioned by engagement of first controlled section 312A with first control section 311A.

Magnet 311, since it is formed of a bonded magnet, offers high dimensional accuracy. Besides, upper plate 312, since it is formed of magnetic powder or a mixture of magnetic powder and resin, offers high dimensional accuracy. Further, by virtue of first control section 311A and first controlled section 312A, upper plate 312 is connected to magnet 311 with high accuracy. Therefore, the inner side surface of upper plate 312 can be disposed close to, or substantially level with the inner side surface of magnet 311. Such positioning minimizes the wasted space on the inner side of the inner periphery of magnet 311, allowing magnetic circuit 314 to have a compact, low-profile, and lightweight structure. At the same time, the structure prevents a gap defect. That is, the structure suppresses the contact between the voice coil and upper plate 312, or the contact between the voice coil and magnet 311. Further, magnetic gap 115 can be decreased, so that magnetic circuit 314 enhances magnetic efficiency.

First control section 311A is a projection and first controlled section 312A is a recess. First control section 311A is inserted in first controlled section 312A. With the structure, upper plate 312 can be properly positioned. Further, the structure increases the contact area of magnet 311 and upper plate 312 therebetween. Therefore, magnet 111 is firmly connected to upper plate 312. In this case, first controlled section 312A is not limited to a recess; first controlled section 312A may be, for example, a thorough hole.

Figure 6B:
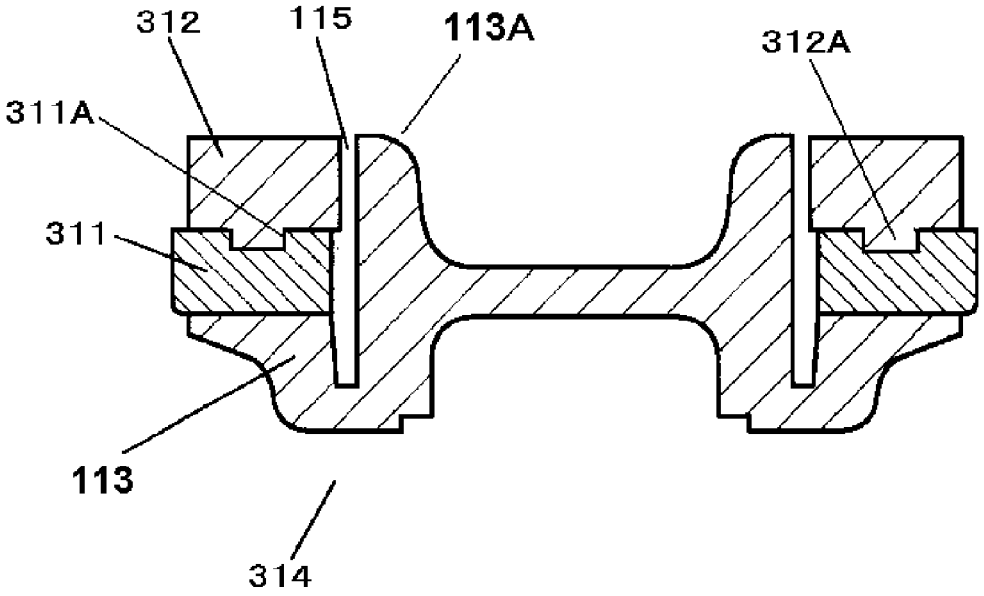
FIG. 6B is a sectional view of still another loudspeaker magnetic circuit in accordance with the exemplary embodiment of the present disclosure.

Similarly, first control section 311A is not limited to a projection. For example, as shown in FIG. 6B, first control section 311A may be a recess and first controlled section 312A may be a projection. In this case, first control section 311A is not limited to a recess; for example, first control section 311A may be a through hole.

First control section 311A is formed at the central part between the inner periphery and the outer periphery of magnet 311. However, the position of first control section 311A is not limited to this; for example, first control section 311A may be formed on or close to the outer peripheral edge of magnet 311. In this case, first controlled section 312A is formed on or close to the outer peripheral edge of upper plate 312.

When magnetic circuit 314 has a circular shape, first control section 311A and first controlled section 312A are arranged so as to be concentric to the inner periphery of magnet 311 and to be rotationally symmetric. When magnetic circuit 314 has a non-circular shape, on the other hand, first control section 311A and first controlled section 312A are arranged to be mirror-symmetric to the center line of magnet 311. With the structure above, upper plate 312 is easily mounted on magnet 311.

When magnetic circuit 314 has a circular shape viewed from above and first controlled section 312A or first control section 311A is a recess, the recess may be formed in an entire circle shape on magnet 311 or upper plate 312. With the structure above, upper plate 312 is easily mounted on magnet 311. Even when magnetic circuit 314 has a non-circular shape, the recess may be formed along the entire periphery of magnet 311 or upper plate 312.

Further, when first control section 311A is formed along the entire periphery of magnet 311, it is preferable that first controlled section 312A be also formed along the entire periphery of magnet 311. With the structure above, the contact area between magnet 311 and upper plate 312 is increased, thereby magnet 311 can be firmly connected to upper plate 312.

Although first control section 311A and first controlled section 312A are formed along the entire periphery, the present disclosure is not limited to this; for example, among first control section 311A and first controlled section 312A, the section formed as a projection may be discretely disposed. Further, both of first control section 311A and first controlled section 312A may be discretely disposed. In this case, first controlled section 312A is disposed at a position that meets with first control section 311A.

Magnet 311, which is formed of a bonded magnet, is produced by injection molding. Upper plate 312 is produced by powder compacting or injection molding. Therefore, magnet 311 and upper plate 312 are highly flexible in shaping. That is, first control section 311A and first controlled section 312A are easily formed integral to magnet 311 and upper plate 312A, respectively. Therefore, magnet 111 and upper plate 312 have no need for a subsequent process for forming first control section 311A and first controlled section 312A. As a result, magnet 311 and upper plate 312 are produced at low cost.

Further, first control section 311A and first controlled section 312A are formed integral to magnet 311 and upper plate 312, respectively, by powder compacting or injection molding. Such forming methods allow first control section 311A and first controlled section 312A to have high accuracy positionally and dimensionally; and accordingly, upper plate 312 is fixed to magnet 311 with high accuracy. In the assembling process of magnetic circuit 314, variations in width of magnetic gap 115 can be minimized with no use of a gauge for determining the width of magnetic gap 115. As a result, magnetic circuit 314 offers good productivity. Further, it is also possible to narrow the width of magnetic gap 115, enhancing magnetic efficiency of magnetic circuit 314.

Figure 7:
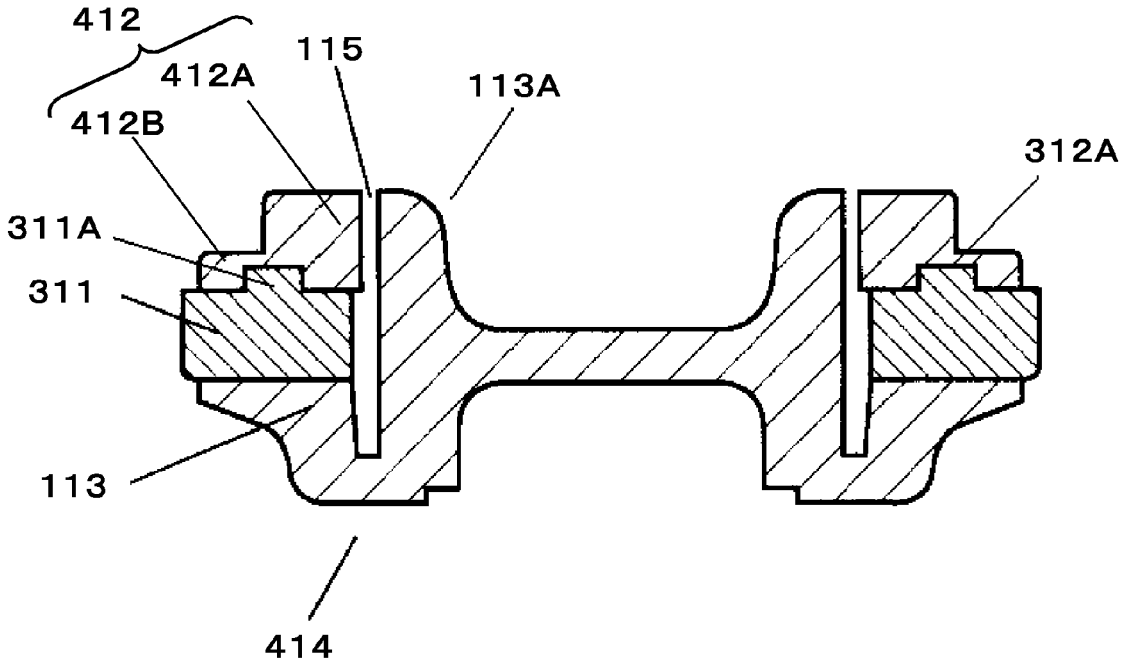
FIG. 7 is a sectional view of still another loudspeaker magnetic circuit in accordance with the exemplary embodiment of the present disclosure.

FIG. 7 is a sectional view of still other magnetic circuit 414 in accordance with the embodiment of the present disclosure. Magnetic circuit 414 is different from magnetic circuit 314 in using upper plate 412 instead of upper plate 312. Upper plate 412 is different from upper plate 312 in that the thickness of the material is partly reduced. That is, upper plate 412 has thick-walled part 412A and thin-walled part 412B with a thickness smaller than part 412A. Upper plate 412 is formed of magnetic powder or a mixture of magnetic powder and resin. The structure further decreases the weight of upper plate 412, providing magnetic circuit 414 with further reduction in weight.

In the structure of upper plate 412, the part having a large effect on flux density in magnetic gap 115 is formed as thick-walled part 412A, and the part having a small effect on flux density in magnetic gap 115 is formed as thin-walled part 412B. With the structure above, the material used for upper plate 412 can be reduced, which decreases the cost of upper plate 412. Further, the structure suppresses decrease in flux density in magnetic gap 115; and at the same time, reduces the weight of upper plate 412.

Magnetic saturation is most likely to occur in the inner periphery of the hole of upper plate 412. Considering this, it is preferable that the inner peripheral side of upper plate 412 be thicker than the outer peripheral side. That is, thick-walled part 412A of upper plate 412 is formed on the magnetic gap side, while thin-walled part 412B of upper plate 412 is formed on the opposite side to the magnetic gap, so that magnetic gap 115 has an appropriate gap width. In contrast, magnetic saturation is unlikely to occur in the outer periphery of upper plate 412 and therefore the thickness of the outer peripheral side of upper plate 412 can be reduced.

Although upper plate 412 is described to have a stepped shape, it is not limited to; for example, the thickness of upper plate 412 may be continuously changed. That is, the thick-walled part and thin-walled part of upper plate 412 may be connected with a sloping boundary therebetween. Further, the boundary between the thick-walled part and the thin-walled part of upper plate 412 may have a thickness with a stepwise change. Further, instead of lower plate 113, lower plate 213 may be employed.

Figure 8:
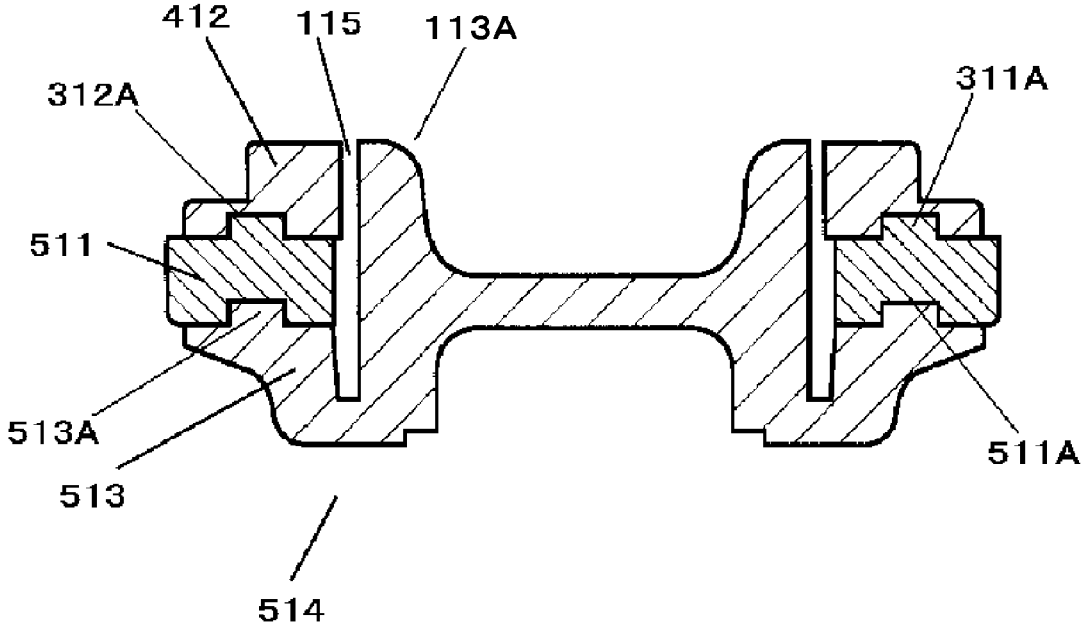
FIG. 8 is a sectional view of still another loudspeaker magnetic circuit in accordance with the exemplary embodiment of the present disclosure.

FIG. 8 is a sectional view of still other magnetic circuit 514 in accordance with the embodiment. Magnetic circuit 514 is different from magnetic circuit 414 in using magnet 511 instead of magnet 311 and lower plate 513 instead of lower plate 113. Lower plate 513 is provided with center pole 113A in the center thereof. Lower plate 513 is formed of magnetic powder or a mixture of magnetic powder and resin.

In the structure above, magnetic gap 115 is formed between the side surface of the upper end of center pole 113A and the inner side surface of upper plate 412. Meanwhile, upper plate 312 may be employed for magnetic circuit 514, instead of upper plate 412.

Similarly to magnet 311, magnet 511 is formed of a bonded magnet. However, magnet 511 is different from magnet 311 in having second controlled section 511A formed on the lower surface. In addition, lower plate 513 is different from lower plate 113 in having second control section 513A formed on the surface on which magnet 311 is to be mounted. In this case, lower plate 513 is formed of magnetic powder or a mixture of magnetic powder and resin.

The structure above, since lower plate 513 is also formed of a mixture of magnetic powder and resin, allows magnetic circuit 514 to have further reduction in weight. Lower plate 513 may contain magnetic member 116 shown in FIG. 2 through FIG. 4B.

Second controlled section 511A is a recess and second control section 513A is a projection. Second control section 513A is inserted in second controlled section 511A. With the structure, magnet 511 is properly positioned. Further, the structure increases the contact area of magnet 511 and lower plate 513 therebetween. Therefore, magnet 511 is firmly connected to lower plate 513. Second controlled section 511A is not limited to a recess; for example, second controlled section 511A may be a thorough hole.

Second controlled section 511A is not limited to a recess; for example, second controlled section 511A may be formed into a projection while second control section 513A may be formed into a recess. In this case, second control section 513A is not limited to a recess; for example, second control section 513A may be a thorough hole.

Magnet 511 is formed of a bonded magnet, and therefore, second controlled section 511A is easily formed integral to magnet 511 by, for example, injection molding. Lower plate 513 is formed of a mixture of a magnetic material and resin, and therefore, second control section 513A is easily formed integral to lower plate 513 by, for example, injection molding.

With the structure above, magnet 511 is accurately mounted on lower plate 513. This allows magnet 511 to be decreased in size of the inner diameter. The structure minimizes the wasted space on the side of the inner periphery of magnet 511, allowing magnetic circuit 514 to be decreased in size.

Second controlled section 511A is formed at the central part between the inner periphery and the outer periphery of magnet 511. However, the position of second controlled section 511A is not limited to; for example, second controlled section 511A may be formed on or close to the outer peripheral edge of magnet 511. In this case, second control section 513A may be formed on or close to the outer peripheral edge of lower plate 513.

When magnetic circuit 514 has a circular shape, second controlled section 511A is disposed to be concentric to the inner periphery of magnet 511 and to be rotationally symmetric. When magnetic circuit 514 has a non-circular shape, second controlled section 511A is disposed to be mirror-symmetric to the center line of magnet 511. With the structure above, magnet 511 is easily mounted on lower plate 513 with high accuracy.

When magnetic circuit 514 has a circular shape and second control section 513A is a recess, the recess may be formed in an entire circle shape on the upper surface of lower plate 513. Similarly, when second controlled section 511A is a recess, the recess may be formed in an entire circle shape on the lower surface of magnet 511. With the structure above, magnet 511 is easily mounted on lower plate 513 with high accuracy. When magnetic circuit 514 has a non-circular shape, the recess may be formed along the entire periphery of magnet 511 or lower plate 513.

Further, when second controlled section 511A is formed along the entire periphery of magnet 511, it is preferable to form second control section 513A also along the entire periphery of lower plate 513. With the structure above, the contact area between magnet 511 and lower plate 513 is increased, by which magnet 511 can be firmly connected with lower plate 513.

Although second controlled section 511A and second control section 513A are formed along the entire periphery, it is not limited to; for example, among second controlled section 511A and second control section 513A, the section formed as a projection may be discretely disposed. Further, both of second controlled section 511A and second control section 513A may be discretely disposed. In this case, second control section 513A is disposed at a position that meets with second controlled section 511A.

Lower plate 513 is obtained in a manner that a mixture of a magnetic material and resin is processed by injection molding. Therefore, lower plate 513 can be easily reduced in thickness of the material at a part in which magnetic saturation is small or a part in which degradation in performance is small. As a result, it is possible to reduce the amount of the material, which provides magnetic circuit 514 with further reduction in weight and cost.

The dimensional accuracy of lower plate 513 is substantially determined by the dimensional accuracy of the mold used for injection molding. Therefore, the dimensional accuracy of lower plate 513 can be easily increased by increasing the dimensional accuracy of the mold for injection molding. Therefore, in the assembling process of magnetic circuit 514, variations in width of magnetic gap 115 can be minimized with no use of a gauge for determining the width of magnetic gap 115.

As described above, the present disclosure is useful for a loudspeaker magnetic circuit and a loudspeaker with the need of reduction in size, thickness, and weight.

What is claimed is:

1. A loudspeaker magnetic circuit of an external-magnet type, the loudspeaker magnetic circuit comprising:

a magnet;

a lower plate including a joint section to which the magnet is connected; and an upper plate disposed on the magnet, wherein the lower plate includes magnetic material and contains a magnetic member embedded therein.

2. The loudspeaker magnetic circuit according to claim 1, wherein the magnetic member is embedded at a section that is likely to cause magnetic saturation.

3. The loudspeaker magnetic circuit according to claim 1, wherein the lower plate has a center pole disposed in a central part and a connecting section connecting the joint section to the center pole, and the magnetic member is embedded in the connecting section.

4. The loudspeaker magnetic circuit according to claim 1, wherein the magnetic member is formed by combining at least one metal material selected from the group consisting of pure iron, ferro silicon, permendur, permalloy, amorphous alloy, sendust, and MnZn alloy.

5. The loudspeaker magnetic circuit according to claim 1, wherein the magnet is formed of a bonded magnet.

6. The loudspeaker magnetic circuit according to claim 1, wherein the magnetic material is selected from the group consisting of pure iron, ferro silicon, permendur, permalloy, amorphous alloy, sendust, and MnZn alloy.

7. The loudspeaker magnetic circuit according to claim 1, wherein the upper plate and the magnet, and the lower plate and the magnet are connected with adhesive, respectively.

8. The loudspeaker magnetic circuit according to claim 1, wherein the upper plate and the magnet, and the lower plate and the magnet are connected by welding, respectively.

9. The loudspeaker magnetic circuit according to claim 1, wherein the magnet is formed of a bonded magnet, the upper plate is formed of a mixture of magnetic material and resin, a first control section is disposed on an upper surface of the magnet, and a first controlled section is disposed on the upper plate so as to be engaged with the first control section.

10. The loudspeaker magnetic circuit according to claim 9, wherein the first control section is one of a projection and a recess, when the first control section is a projection, the first controlled section is a recess, and when the first control section is a recess, the first controlled section is a projection, and the projection is inserted in the recess.

11. The loudspeaker magnetic circuit according to claim 10, wherein the recess is formed on an entire periphery.

12. The loudspeaker magnetic circuit according to claim 9, wherein the upper plate has different thicknesses in part.

13. The loudspeaker magnetic circuit according to claim 12, wherein the lower plate has a center pole disposed in a central part, a magnetic gap is formed between a side surface of the center pole and an inner side surface in a hole of the upper plate, and the upper plate has a thick-walled part disposed on a magnetic gap side and a thin-walled part that is disposed on an opposite side to the magnetic gap and has a thickness smaller than the thick-walled part.

14. The loudspeaker magnetic circuit according to claim 9, wherein the lower plate is formed of a mixture of magnetic powder and resin.

15. The loudspeaker magnetic circuit according to claim 14, wherein the lower plate has a second control section disposed on a surface on which the magnet is to be mounted, and the magnet has a second controlled section on a lower surface so as to engage with the second control section.

16. The loudspeaker magnetic circuit according to claim 15, wherein the second control section is one of a projection and a recess, when the second control section is a projection, the second controlled section is a recess, and when the second control section is a recess, the second controlled section is a projection, and the projection is inserted in the recess.

17. The loudspeaker magnetic circuit according to claim 1, wherein the lower plate has a center pole in a central part, a magnetic gap is formed between a side surface of the center pole and an inner side surface in a hole of the upper plate, the upper plate is formed of a mixture of magnetic powder and resin, and a compounding ratio of magnetic powder on a magnetic gap side in the upper plate is larger than a compounding ratio of magnetic powder on an opposite side to the magnetic gap in the upper plate.

18. The loudspeaker magnetic circuit according to claim 1, wherein the lower plate has a center pole in a central part, a magnetic gap is formed between a side surface of the center pole and an inner side surface in a hole of the upper plate, the lower plate is formed of a mixture of magnetic powder and resin, and a compounding ratio of magnetic powder in an outer diameter section of the center pole is larger than a compounding ratio of magnetic powder in a central section of the center pole.

19. A loudspeaker comprising:

a loudspeaker magnetic circuit defined in claim 1;

a frame connected to the magnetic circuit;

a voice coil inserted in the magnetic gap in the loudspeaker magnetic circuit; and a diaphragm connected to the voice coil and also connected to an outer periphery of the frame at a peripheral section.

20. The loudspeaker magnetic circuit according to claim 1, wherein the lower plate is an injection-molded article.

21. The loudspeaker magnetic circuit according to claim 20, wherein the magnetic member is embedded in the lower plate by insert or outsert molding.

22. The loudspeaker magnetic circuit according to claim 1, wherein the lower plate is formed of a mixture of magnetic powder and resin.

23. The loudspeaker magnetic circuit according to claim 1, wherein the upper plate is formed of a mixture of magnetic powder and resin.

* * * * *